United States Patent [19]

Addy et al.

[11] Patent Number: 4,942,275

[45] Date of Patent: Jul. 17, 1990

[54] CONTROL PANEL FACE

[75] Inventors: Timothy E. Addy, Montgomery, Ala.; Warner E. Speakman, Brighton, Tenn.

[73] Assignee: ESI Companies, Inc., Memphis, Tenn.

[21] Appl. No.: 193,401

[22] Filed: May 12, 1988 (Under 37 CFR 1.47)

[51] Int. Cl.[5] ..... H01H 9/00

[52] U.S. Cl. ..... 200/308; 200/309; 200/294; 200/512; 200/5 A; 341/23; 340/525; 340/815.12; 40/621

[58] Field of Search ..... 200/308, 5 A, 302.2, 200/309, 310, 312, 317, 294, 296, 512; 340/815.06, 815.07, 815.12, 815.13, 815.15, 815.16, 815.2, 525; 40/426, 463, 464, 465, 600, 621; 341/23

[56] References Cited

U.S. PATENT DOCUMENTS

| | | | |
|---|---|---|---|
| 3,508,356 | 4/1970 | Ross | 40/600 |
| 3,701,869 | 10/1972 | Jacob et al. | 200/308 |
| 3,965,599 | 6/1976 | Ebner | 40/600 X |
| 4,066,850 | 1/1978 | Heys, Jr. | 200/5 A |
| 4,101,884 | 7/1978 | Benton, Jr. | 40/621 X |
| 4,119,839 | 10/1978 | Beckmann et al. | 341/23 X |
| 4,126,855 | 11/1978 | Alms et al. | 340/815.2 X |
| 4,336,530 | 6/1982 | Koike et al. | 341/23 |
| 4,439,757 | 3/1984 | Gross et al. | 341/23 |
| 4,684,940 | 8/1987 | Charmeux | 340/815.2 |

FOREIGN PATENT DOCUMENTS

| | | | |
|---|---|---|---|
| 742756 | 1/1956 | United Kingdom | 340/815.12 |

OTHER PUBLICATIONS

IBM Technical Disclosure Bulletin, "Keyboard with Changeable Encoding and Key Designation", vol. 13, No. 7, 12-1970.

IBM Technical Disclosure Bulletin, "Interchangeable Keyboard Character Indicator", vol. 14, No. 8, 12-1970.

*Primary Examiner*—Ernest G. Cusick

[57] ABSTRACT

A control panel face for mounting at least one control member. The control panel face includes a base having a face surface onto which at least a portion of the control member is positioned, at least a portion of the face surface being magnetic; a flexible magnetic sheet for being removably attached to the face surface of the base over the control member; and a flexible cover sheet for being attached to the magnetic sheet and for covering the aperture through the magnetic sheet, the cover sheet including indicia for identifying the control member.

8 Claims, 1 Drawing Sheet

CONTROL PANEL FACE

BACKGROUND OF THE INVENTION

1. Field of the Invention

The present invention relates to a control panel face.

2. Description of the Related Art

Various control panels and the like are disclosed by the following patents: Willoughby, U.S. Pat. No. 3,624,648; Fitzgerald, U.S. Pat. No. 4,301,449; Calandrelle et al, U.S. Pat. No. 4,439,647; Kawauchi, U.S. Pat. No. 4,501,938; Nemitz, U.S. Pat. No. 4,510,353; Maguire, U.S. Pat. No. 4,523,060; and Latasiewicz, U.S. Pat. No. 4,551,586. None of the above patents disclose or suggest the present invention.

Complex control panels including a plurality of control members such as electrical switches and the like are used for monitoring, displaying and controlling various operations in manufacturing and process plants and the like. A graphic display may be combined with the control panel to allow operators to easily understand and read the various displays and properly regulate the various control members, etc. Fitzgerald, U.S. Pat. No. 4,301,449 discloses such a combined control panel/-graphic display.

SUMMARY OF THE INVENTION

The present invention is directed toward providing an improved control panel face. The concept of the present invention is to provide a face for a control panel which includes sufficient indicia for indicating the functions controlled by the control panel and which can be easily modified to change both the functions controlled thereby and the indicia thereon.

The control panel face of the present invention includes a base having a face surface onto which at least a portion of a control member is positioned, at least a portion of the face surface being magnetic; a flexible magnetic sheet for being removably attached to the face surface of the base over the control member; and a flexible cover sheet for being attached to the magnetic sheet, the cover sheet including indicia for identifying the control member.

DESCRIPTION OF THE PREFERRED EMBODIMENT

The control panel face 11 of the present invention is used to support at least one control member 13 such as a membrane switch. The control member 13 is electrically coupled to an electrical circuit by wires 13' to control various electrical functions and the like. The electrical circuit may include a light-emitting means 15 such as a typical light-emitting diode for indicating the position of the control member 13 as will now be apparent to those skilled in the art. The electrical circuit will typically include a plurality of control members 13 and light-emitting means 15 to control a complex process or the like as will now be apparent to those skilled in the art.

Figure 1:
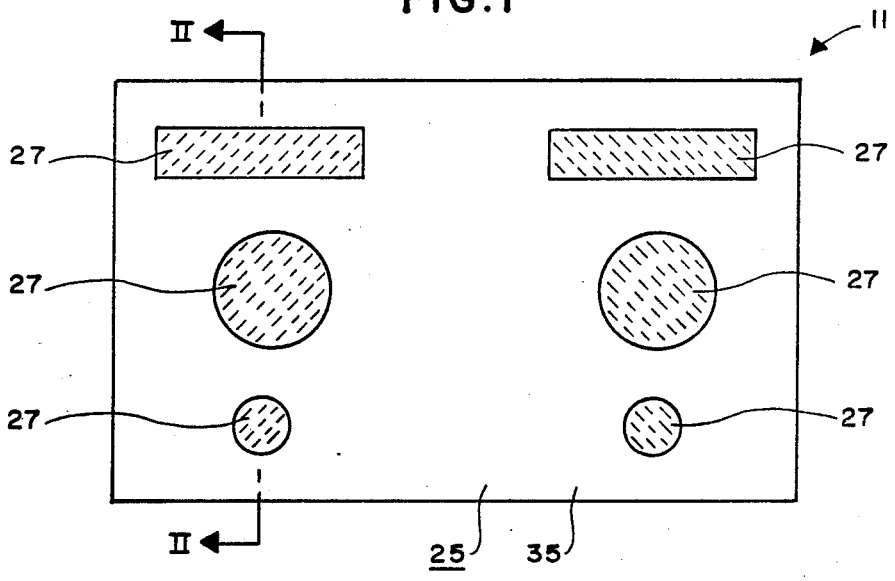
FIG. 1 is a somewhat diagrammatic front elevation of the control panel face of the present invention.
Figure 2:
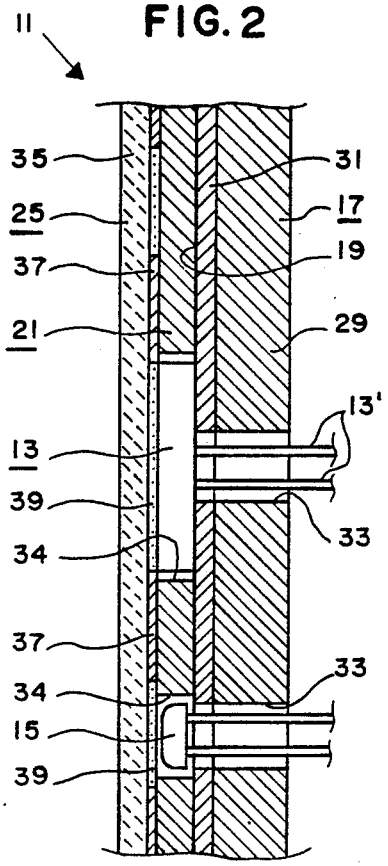
FIG. 2 is an enlarged sectional view substantially as taken on line II—II of FIG. 1.
Figure 3:
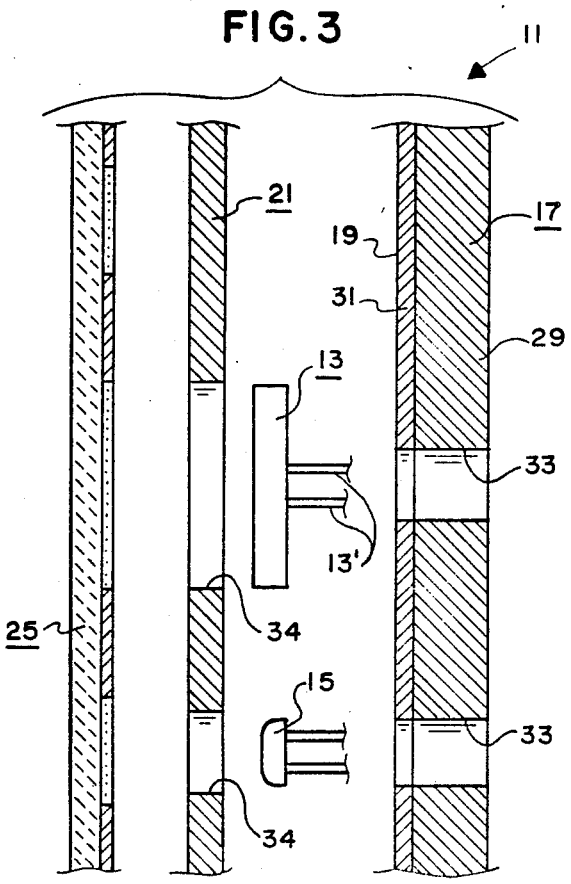
FIG. 3 is an exploded sectional view similar to FIG. 2.

The control panel face 11 includes a base 17 having a face surface 19 onto which at least a portion of the control member 13 is positioned, includes a flexible magnetic sheet or panel 21 for being removably attached to the face surface 19 of the base over the control member 13, and includes a flexible cover sheet or panel 25 for being attached to the magnetic sheet 21. The cover sheet 25 includes indicia 27 for identifying the control member 13. While the indicia 27 is shown in FIG. 1 diagrammatically, the indicia 27 may include written text, color-code flow diagrams, symbols and the like as will now be apparent to those skilled in the art.

The base 17 preferably includes a first plate 29 and a second plate 31. The second plate 31 is preferably removably attached to the first plate 29 by bolts, screws or the like (not shown) and forms or defines the face surface 19. Thus, the second plate 31 is made out of magnetic material for allowing the magnetic sheet 21 to be removably attached thereto. More specifically, the first plate 29 is preferably constructed of an easily machined material such as aluminum and the second plate 31 is preferably constructed of a highly magnetic material such as sheet steel. The base 17 preferably has at least one aperture 33 therethrough for allowing the control member 13 to be electrically coupled therethrough. More specifically, the base 17 preferably has an aperture 33 through the first and second plates 29, 31 for each control member 13 and light-emitting means 15 of the control panel.

The magnetic sheet 21 preferably consist of a typical flexible magnetic sheet material well known to those skilled in the art and commonly used for magnetic tape and the like. The magnetic sheet 21 preferably has at least one aperture 34 therethrough for allowing the control member 13 to be easily controlled. More specifically, the magnetic sheet 21 preferably has an aperture 34 therethrough for each control member 13 and light-emitting means 15 of the control panel.

The cover sheet 25 preferably includes a transparent sheet 35 having a face surface and a rear surface with a portion of the rear surface thereof being covered by an opaque paint 37 to define a negative image of the indicia 27. At least a portion of the rear surface of the transparent sheet 35 not covered with the opaque paint 37 is preferably covered with a contrasting paint 39 to clearly form at least a portion of the indicia 27. The opaque paint 37 may be applied by a typical silk-screening process or the like as will now be apparent to those skilled in the art and the contrasting paint 39 may be applied manually with the various control members 13 and the like color-coded to allow the control panel to be easily and quickly used and understood. It should be noted that the indicia 27 over the light-emitting means 15 is either translucent or clear to allow light to easily pass through the cover sheet 25 as will now be apparent to those skilled in the art.

The specific construction of the control panel face 11 will depend on the specific design and layout of the control panel it is to be used with as will now be apparent to those skilled in the art. Thus, the base 17 is manufactured to receive the specific combination of control members 13 and light-emitting means 15 in the specific locations determined by the overall size and layout of the control panel. The various specific indicia 27 is then applied to the cover sheet 25 again depending on the overall size and layout of the control panel. The apertures 34 are then cut or otherwise formed through the magnetic sheet 21 in any manner now apparent to those skilled in the art at locations again depending on the overall size and layout of the control panel. The magnetic sheet 21 is then attached to the rear surface of the cover sheet 25 with glue or the like as will now be apparent to those skilled in the art. The cover sheet 25—magnetic sheet 21 unit can then be removably attached to the base 17 to thereby form the control panel face 11. If the specific layout of the control panel then changes, the cover sheet 25—magnetic sheet 21 unit can easily be pulled from the base 17 to allow additional apertures 33 to be drilled through the base 17 to allow additional control members 13 and light-emitting means 15 to be added, to allow the location of existing control members 13 and light-emitting means 15 to be changed, etc. The magnetic sheet 21 can then be separated from the cover sheet 25 to allow new apertures 34 to be cut through the magnetic sheet 21 and to allow the indicia 27 on the cover sheet 25 to be changed, etc. The modified cover sheet 25—magnetic sheet 21 unit can then be attached to the modified base 17 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A control panel face for supporting at least one control member, said control panel face comprising:

(a) a base having a face surface for receiving at least a portion of said at least one control member, at least a portion of said face surface being made out of magnetic material;

(b) a flexible magnetic sheet for being removably attached to said face surface of said base over said at least one control member; said magnetic sheet having at least one aperture therethrough for allowing said at least one control member to be controlled therethrough; and (c) a flexible cover sheet for being attached to said magnetic sheet, said cover sheet including indicia for identifying said at least one control member.

2. The control panel face of claim 1 in which said base includes a first plate and a second plate, said second plate being attached to said first plate and forming said face surface.

3. The control panel face of claim 2 in which said second plate is made out of magnetic material.

4. The control panel face of claim 2 in which said first plate is constructed of aluminum and in which said second plate is constructed of steel.

5. The control panel face of claim 1 in which said base has at least one aperture therethrough for allowing said at least one control member to be electrically coupled therethrough.

6. The control panel face of claim 1 in which said cover sheet includes a transparent sheet having a face surface and a rear surface, a portion of said rear surface of said transparent sheet being covered by an opaque paint to define a negative image of said indicia.

7. The control panel face of claim 6 in which a portion of said rear surface of said transparent sheet not covered with said opaque paint is covered with a contrasting paint.

8. A control panel face for supporting at least one control member, said control panel face comprising:

(a) base having a face surface for receiving at least a portion of said at least one control member, at least a portion of said face surface being made out of megnetic material;

(b) a magnetic sheet for being removably attached to said face surface of said base over said at least one control member; said magnetic sheet having at least one aperture therethrough for allowing said at least one control member to be controlled therethrough; and (c) a cover sheet for being attached to said magnetic sheet, said cover sheet including indicia for identifying said to least one control member.

* * * * *